US011445788B2

(12) United States Patent
Viller et al.

(10) Patent No.: US 11,445,788 B2
(45) Date of Patent: Sep. 20, 2022

(54) BRACELET CLASP

(71) Applicant: OMEGA SA, Biel/Bienne (CH)

(72) Inventors: Alexis Viller, Allinges (FR); Eric Vuilleme, Provence (CH)

(73) Assignee: OMEGA SA, Biel/Bienne (CH)

( * ) Notice: Subject to any disclaimer, the term of this patent is extended or adjusted under 35 U.S.C. 154(b) by 874 days.

(21) Appl. No.: 16/211,541

(22) Filed: Dec. 6, 2018

(65) Prior Publication Data

US 2019/0183213 A1 Jun. 20, 2019

(30) Foreign Application Priority Data

Dec. 19, 2017 (EP) ..... 17208485

(51) Int. Cl.
*A44C 5/24* (2006.01)
*A44C 5/18* (2006.01)

(52) U.S. Cl.
CPC ..... *A44C 5/18* (2013.01); *A44C 5/246* (2013.01); *A44D 2200/10* (2013.01)

(58) Field of Classification Search
CPC ..... A44C 5/18; A44C 5/246
See application file for complete search history.

(56) References Cited

U.S. PATENT DOCUMENTS 5,787,554 A * 8/1998 Hashimoto ..... A44C 5/185 24/265 WS
8,935,834 B2 * 1/2015 Mouche ..... A44C 5/24 24/265 WS (Continued)

FOREIGN PATENT DOCUMENTS

CH 696 697 A5 10/2007
EP 1 716 776 A2 11/2006

(Continued)

OTHER PUBLICATIONS

European Search Report dated May 24, 2018 in European Application 17208485.7 filed on Dec. 19, 2017 (with English Translation of Categories of Cited Documents).

*Primary Examiner* — Jason W San
(74) *Attorney, Agent, or Firm* — Oblon, McClelland, Maier & Neustadt, L.L.P.

(57) ABSTRACT

A bracelet clasp including first and second blades, the first blade being articulated to the second blade by a first end, between a closed position, in which the second blade is folded over the first blade, and an open position in which the second blade is free from the first blade, the second blade bearing, at a second end, a member for fastening a first bracelet strand, a second bracelet strand being connected at least indirectly to the first blade. A locking device holds the first blade in its closed position. A device for adjusting the wear length of the bracelet includes a cover mounted on a base plate secured to the second end of the second blade, and the member for fastening the first bracelet strand sliding between the cover and the base plate in a longitudinal direction of the clasp between a first position in which the fastening member is at least partially engaged in the cover of the clasp towards at least a second position in which the fastening member is free from the cover of the clasp by pressure on the cover in a direction perpendicular to the clasp to cause same to slide.

10 Claims, 3 Drawing Sheets

(56) References Cited

U.S. PATENT DOCUMENTS

| | | | | |
|---|---|---|---|---|
| 9,003,611 | B2 * | 4/2015 | Catanese | A44C 5/246 24/71 J |
| 9,591,899 | B2 * | 3/2017 | Catanese | A44C 5/246 |
| 9,615,634 | B2 * | 4/2017 | Kaltenrieder | A44C 5/24 |
| 9,681,711 | B2 * | 6/2017 | Monard | A44C 5/246 |
| 10,278,460 | B2 * | 5/2019 | Catanese | A44C 5/246 |
| 11,284,684 | B2 * | 3/2022 | Schaller | A44C 5/246 |
| 2012/0110792 | A1 * | 5/2012 | Gran | A44C 5/246 24/265 EC |
| 2017/0215531 | A1 * | 8/2017 | Wong | A44C 5/246 |
| 2018/0352914 | A1 * | 12/2018 | Vuilleme | A44C 5/246 |

FOREIGN PATENT DOCUMENTS

| | | |
|---|---|---|
| EP | 2 248 437 A1 | 11/2010 |
| JP | 2005-270248 | 10/2005 |

* cited by examiner

BRACELET CLASP

CROSS-REFERENCE TO RELATED APPLICATION

This application claims priority to European Patent Application No. 17208485.7 filed on Dec. 19, 2017, the entire disclosure of which is hereby incorporated herein by reference.

FIELD OF THE INVENTION

The invention relates to a bracelet clasp with adjustment and, in particular, for watch bracelets.

BACKGROUND OF THE INVENTION

Document EP 1 464 245 teaches a clasp with a folding buckle comprising two curved arms, one being a lower arm and the other being an upper arm, each provided with a concave face and a convex face, the concave face of the upper arm being adjacent to the convex face of the lower arm in the closed position of the clasp, the upper arm being elastically deformable in flexion, locking means, comprising two parts, each associated with one of the arms, the first part comprising at least two cuts and the second part comprising a head arranged such as to notch into one or the other cut by elastic deformation of the upper arm, linking means connecting the arms to one another in an articulated manner at one of their ends, about an pin substantially parallel to the faces of the arms and allowing the upper arm to occupy at least two positions in which the head may be engaged in one or the other of the cuts, and means for fastening the strands of a bracelet that are arranged at the other end of the arms.

It is not easy for a user to manipulate a mechanism of this type because the pin can move with the arm, which means that the pin may overhang as a function of play and block the arm in an undesired position. Moreover, locking of the position is not entirely reliable and there is a risk that in a short position the clasp, upon opening, will pass into a long position contrary to the user's wishes.

SUMMARY OF THE INVENTION

An object of the invention is notably to palliate the various drawbacks of these known techniques.

More precisely, an object of the invention is to provide a clasp allowing simple, rapid adjustment of the length of a bracelet strand.

These objects and others, also, which will become more clearly apparent below, are achieved according to the invention with the aid of a bracelet clasp comprising at least first and second blades, the first blade being articulated to the second blade by a first end, between a closed position, the "wear position", in which the second blade is folded over the first blade, and an open position in which the second blade is free from the first blade, the second blade bearing, at a second end, a member for fastening a first bracelet strand, a second bracelet strand being connected at least indirectly to the first blade, the clasp further comprising:

locking means suitable for holding the first blade in its closed position, means for adjusting the wear length of the bracelet, the means for adjusting the wear length of the bracelet comprising a cover mounted on a base plate secured to the second end of the second blade, and said member for fastening the first bracelet strand sliding between the cover and the base plate.

According to the invention, the fastening member slides in a longitudinal direction of the clasp between a first position in which the fastening member is at least partially engaged in the cover of the clasp towards at least a second position in which the fastening member is free from the cover of the clasp by exerting a pressure on the cover in a direction perpendicular to the clasp in order to cause same to slide.

According to other advantageous variants of the invention:

- the fastening member comprises at least a first notch and a second notch arranged in order to pass from a first position in which the first notch is in an engagement with a boss integral with the base plate to a second position in which the second notch is in engagement with said boss;
- the locking means comprise at least one pusher mounted between the base plate and the cover;
- the cover comprises a first machining in which said fastening member of the bracelet slides, said member having a form that complements the form of the machining;
- the fastening member comprises stop means defining the travel of said fastening member;
- the cover comprises a second machining for receiving said at least one pusher;
- said at least first and second notches are formed directly in said fastening member;
- the base plate, said at least one pusher, said adjustment member and the cover are superposed in succession one above another;
- the locking means comprise at least one spring configured in order to interact with said at least one pusher such as to stress the pusher in the locked position;
- the base plate comprises means for guiding said at least one pusher;
- the first blade comprises a stud integral with the latter, said stud being arranged in order to pass through an orifice in the base plate and to interact with said at least one pusher.

The invention also relates to a wristwatch comprising a bracelet provided with a clasp according to the invention.

Thus, owing to its different functional and structural aspects described above, the subject of the present invention makes it possible to obtain a clasp in which adjustment of the length of a strand is particularly quick and easy.

BRIEF DESCRIPTION OF THE DRAWINGS

Other features and advantages of the invention will become more clearly apparent upon reading the following description of a particular embodiment of the invention given as an illustrative, non-limiting simple example, and of the figures in which.

DETAILED DESCRIPTION OF THE PREFERRED EMBODIMENTS

Figure 1:
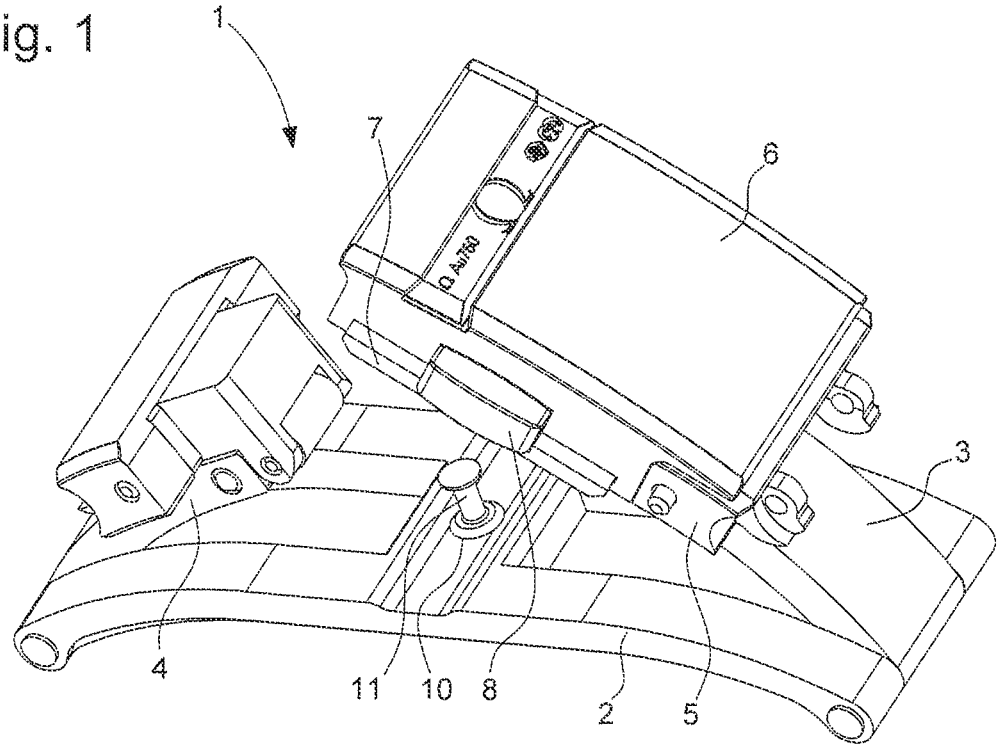
FIG. 1 is a perspective view of a clasp according to the invention.

An adjustable-strand bracelet clasp according to a first exemplary embodiment will now be described below with reference jointly to FIGS. 1, 2, 3, 4*a*, 4*b*, 5, 6*a*, 6*b* and 6*c*.

The invention relates to a bracelet clasp 1, of the type with a folding buckle, comprising at least first and second blades, the second blade 3 being articulated to the first blade 2 by a first end, between a closed position, the "wear position", in which the second blade 3 is folded over the first blade 2, and an open position in which the second blade 3 is free from the first blade 2.

The second blade 3 bears at a second end a fastening member 30 of a first bracelet strand, a second bracelet strand being connected at least indirectly to the first blade 2 by means of an attachment link 5, for example, the first blade 2 comprising locking means capable of holding the second blade 3 in its closed position. The fastening means of the first bracelet strand or of the first link may be in the form of a third blade 4, as illustrated in the figures, or it might also be possible to imagine the strand or the link being fixed directly to the first blade 2 or fixed indirectly to the first blade 2 via an articulated intermediate element.

The strands may be manufactured in materials such as leather, cloth, fabric or any other material known to a person skilled in the art for producing bracelets or belts.

It will also be possible to fasten bracelet links thereto, be these made from metal, ceramic, composite material or any other material known to a person skilled in the art for the manufacture of links.

The first blade 2 may, for example, have a through-orifice at its centre, called the "central orifice" 10, the central orifice being configured in order to receive a stud 11 such that the stud interacts with pushers or any other locking means of the clasp well known to a person skilled in the art within the context of the present invention. On the first blade 2 it might also be possible to fit fixed hooks configured in order to interact with other hooks arranged on pushers, for example.

Advantageously, the clasp comprises means for adjusting the wear length of the bracelet, the adjustment means comprising a cover 6 translatably articulated to the base plate 7 via its lateral edges, the base plate 7 being secured to the second end of the second blade 3 via an intermediate articulation element 70, the fastening member of the first bracelet strand being mounted slideably between the cover 6 and the base plate 7.

Figure 2:
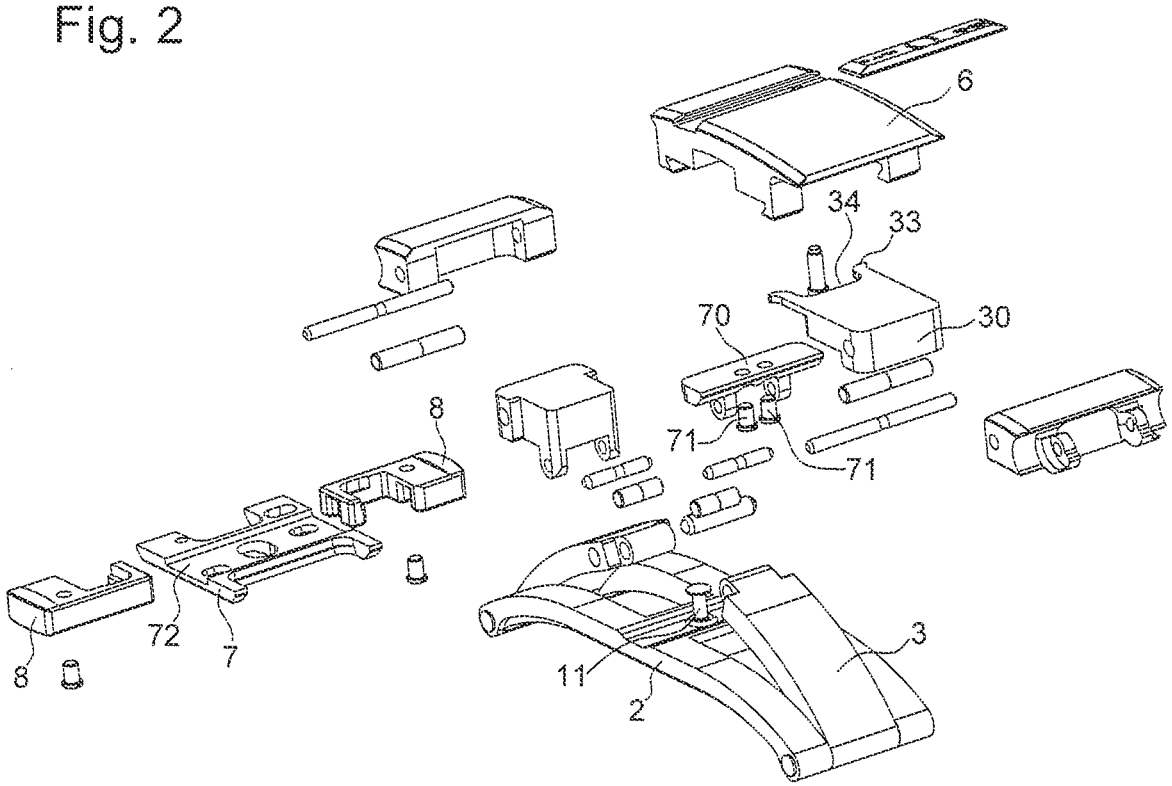
FIG. 2 is an expanded view of a clasp according to the invention.
Figure 3:
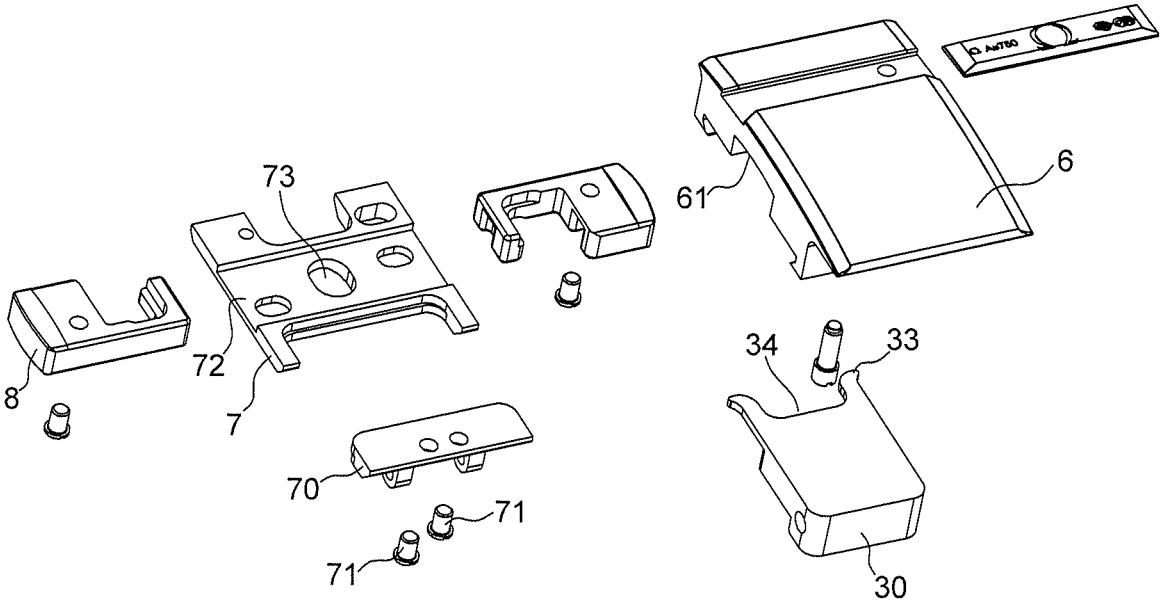
FIG. 3 is an expanded view of the adjustment means of a clasp according to the invention.

As may be seen in FIGS. 2 and 3, the fastening member 30 is moveable and slides in a longitudinal direction of the clasp 1 between at least a first position in which the fastening member 30 is at least partially engaged in the cover 6 of the clasp towards at least a second position in which the fastening member 30 is free from the cover 6 of the clasp by exerting a pressure on the cover 6 in a direction perpendicular to the clasp in order to cause same to slide.

Figure 4A:
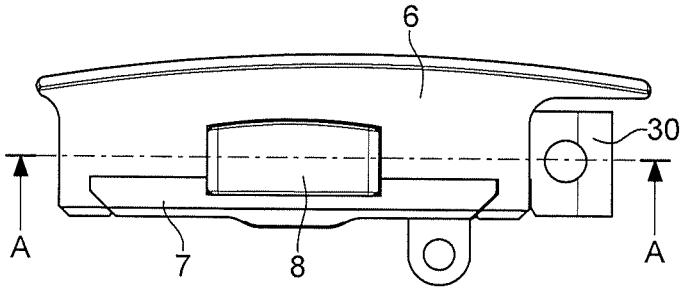
FIGS. 4*a* and 4*b* respectively illustrate a profile view and a sectional view on the line AA in FIG. 4*a* of the adjustment means of a clasp according to the invention.
Figure 4B:
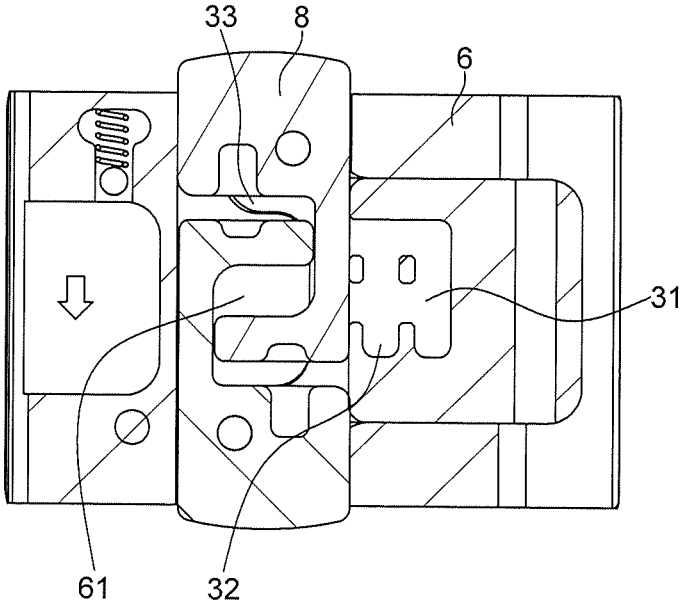
Figure 5:
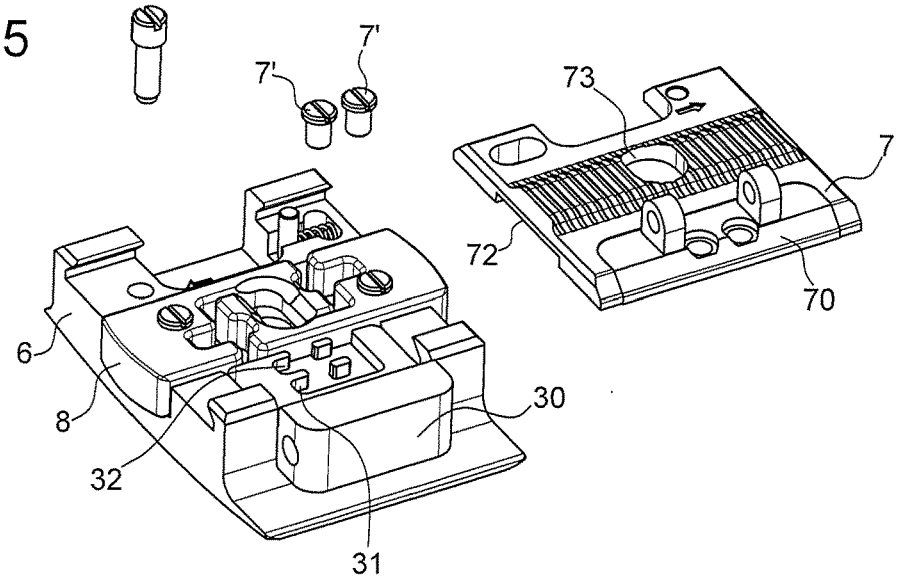
FIG. 5 is a bottom view in perspective of the adjustment means of a clasp according to the invention.
Figure 6A:
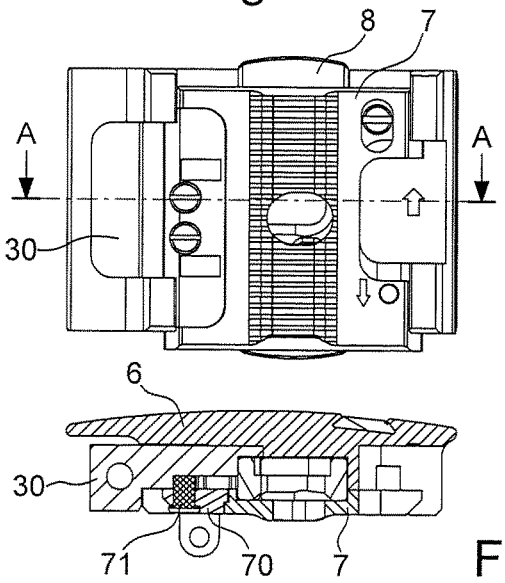
FIGS. 6*a* to 6*c* illustrate the kinematics of the adjustment means for modifying the wear length of a bracelet.
Figure 6B:
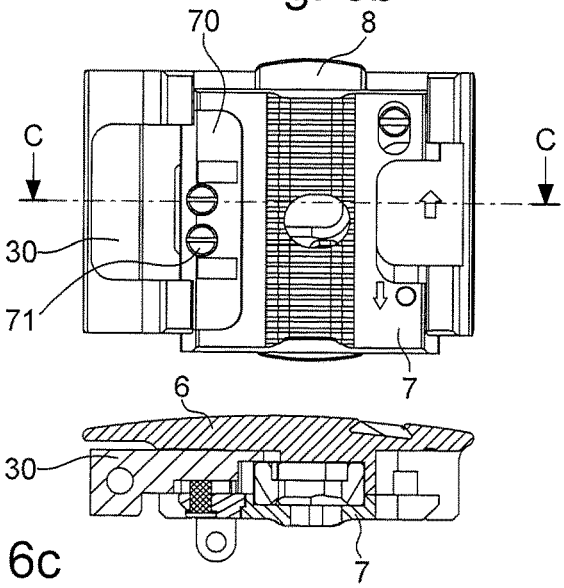
Figure 6C:
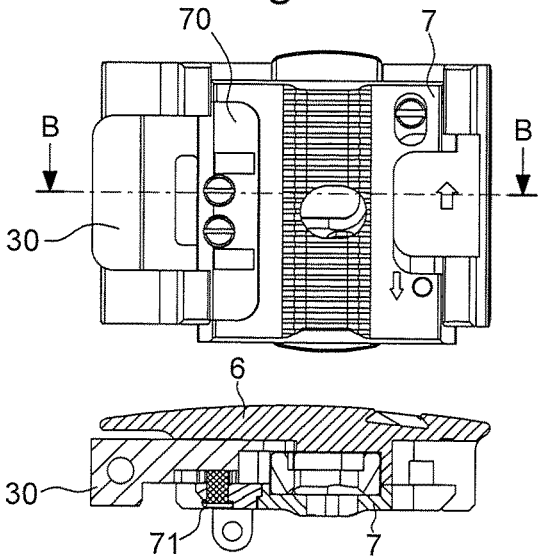

According to the invention, and as illustrated in FIG. 4*b*, the fastening member 30 comprises at least a first notch 31 and a second notch 32, the fastening member 30 being arranged in order to pass from a first position in which the first notch 31 is in engagement with a boss 71 integral with the base plate to a second position in which the second notch 32 is in engagement with the boss 71. The first and second notches 31 and 32 are machined directly in the fastening member 30. Quite obviously, the fastening member may have a plurality of adjustment notches in accordance with the wearer's requirements and morphology.

The cover 6 comprises a first machining 60, in the direction of the length, in which the fastening member 30 is accommodated and slides, the member having a form that complements the form of the machining in order to limit play after assembly. Furthermore, the fastening member 30 comprises stop means 33 that define the length of travel thereof and enable same also to avoid being dislodged from the machining 60.

As illustrated in FIGS. 3 and 4*b*, the fastening member 30 has a recess 34 in the immediate vicinity of the stop means 33 such as to allow the boss 11 to pass.

The cover 6 also comprises a second machining 61, of rectangular form in the direction of the width, for receiving at least one pusher, or two pushers as can be seen in the figures, the pusher or pushers being mounted between the base plate 7 and the cover 6.

The first machining 60 and the second machining 61 intersect and form a zone defining the length of travel of the stop means, the latter moving in said formed zone.

As may be seen in FIG. 3, the fastening member 30 has three distinct levels, a first level comprising the stop means 33, a second level that is thicker than the first level and comprises the notches 31, 32, and a third level that is thicker than the second level and comprises means for attachment of a bracelet strand or of a link.

An arrangement of this type makes it possible to have the base plate 7, the pushers 8, the adjustment member 30 and the cover 6 superposed in succession above one another, the adjustment member 30 being held between the cover 6 and the pushers 8 and/or the base plate 7.

The base plate 7 comprises a guide groove 72 for the pusher or pushers 8, the guide groove having a form that complements the form of the pushers, namely a rectangular form.

The base plate 7 also comprises a through-hole 73 in the groove 72 through which the stud 11 integral with the first blade 2 passes. The two pushers 8 are arranged in order to be moved in a direction perpendicular to the clasp 1, in response to a pressure from the user, between a first, rest position in which the cover 6, member 30 and base plate 7 assembly is locked in the closed position on the first blade 2 and a second, pushed position in which the assembly is free from the first blade 2.

The pushers 8 are formed by a body that is longer than the width of the cover 6 and of the base plate 7 such as to project on either side of the cover. The pushers 8 are mounted slideably and bearingly interact with a spring in order to keep the pushers apart. As may be seen in the figures, each pusher has a passage and a hook to allow the stud 11 to pass and to hold it when the pushers are stressed by the spring.

According to a particularly advantageous aspect of the invention, the user is able to press the pusher 8 and the cover 6 in a direction perpendicular to the clasp in order to facilitate manipulation.

Thus, in order to adjust the clasp, the user first unfolds the second blade 3 from the first blade 2. Next, the user bears on the cover 6 and, optionally, the pusher 8 just below such as to offset the cover 6 from its rest position towards one of the adjustment positions, as in FIGS. 6*a* to 6*c*, and thus the bosses that were offset relative to the notches are placed opposite passages provided in the notches 31 and 32, and the wearer is then able to move the adjustment member 30 in the required position. Lastly, once the adjustment member has been positioned in the required notch, the wearer releases the pressure exerted on the cover 6, which returns to its rest position through the effect of a spring interacting with a pin, both being visible in FIGS. 4*b* and 5. The pin being integral with the base plate 7 and defining the length of travel of the cover 6, the wearer now has only to close the clasp 1 in order to wear the watch.

The invention also relates to a wristwatch comprising a bracelet provided with a clasp as described above.

By virtue of these various aspects of the invention, a clasp of simple design that makes it possible to adjust the length of a bracelet strand is provided.

Of course, the present invention is not limited to the example illustrated and may be embodied in various variants and modified forms that will become apparent to a person skilled in the art.

The invention claimed is:

1. A bracelet clasp comprising:

at least first and second blades, the first blade being articulated to the second blade by a first end, between a closed position, wherein the second blade is folded over the first blade, and an open position wherein the second blade is free from the first blade, the second blade bearing, at a second end, a fastening member for fastening a first bracelet strand, a second bracelet strand being connected at least indirectly to the first blade;

locking means suitable for holding the first blade in its closed position; and means for adjusting a wear length of the bracelet, the adjustment means comprising a cover mounted on a base plate secured to the second end of the second blade, and said fastening member sliding between the cover and the base plate, wherein the fastening member is moveable and slides in a longitudinal direction of the clasp between at least a first position wherein the fastening member is at least partially engaged in the cover of the clasp towards at least a second position wherein the fastening member is free from the cover of the clasp by exerting a pressure on the cover in a direction perpendicular to the clasp in order to cause same to slide, wherein the fastening member includes at least a first notch and a second notch arranged in order to pass from a first position wherein the first notch is in an engagement with a boss integral with the base plate to a second position wherein the second notch is in engagement with said boss, and wherein the fastening member further includes stop means positioned along an outer side surface of the fastening member so as to define a travel distance of the fastening member in the longitudinal direction.

2. The clasp according to claim 1, wherein the locking means comprise at least one pusher mounted between the base plate and the cover.

3. The clasp according to claim 1, wherein the cover comprises a first machining wherein said fastening member of the bracelet slides, said fastening member having a form that complements the form of the machining.

4. The clasp according to claim 2, wherein the cover comprises a second machining for receiving said at least one pusher.

5. The clasp according to claim 1, wherein said at least first and second notches are formed directly in said fastening member.

6. The clasp according to claim 2, wherein the base plate, said at least one pusher, said adjustment member and the cover are superposed in succession one above another.

7. The clasp according to claim 2, wherein the locking means comprise at least one spring configured in order to interact with said at least one pusher such as to stress the pusher in a locked position.

8. The clasp according to claim 2, wherein the base plate comprises means for guiding said at least one pusher.

9. The clasp according to claim 2, wherein the first blade comprises a stud integral with the latter, said stud being arranged in order to pass through an orifice in the base plate and to interact with said at least one pusher.

10. A wristwatch comprising a bracelet provided with a clasp according to claim 1.

* * * * *